US008910551B2

(12) United States Patent
Schürch et al.

(10) Patent No.: US 8,910,551 B2
(45) Date of Patent: Dec. 16, 2014

(54) APPARATUS FOR PUNCHING MOVING MATERIAL WEBS

(75) Inventors: Thomas Schürch, Rothrist (CH); André Meznaric, Bern (CH)

(73) Assignee: Hunkeler AG, Wikon (CH)

( * ) Notice: Subject to any disclaimer, the term of this patent is extended or adjusted under 35 U.S.C. 154(b) by 361 days.

(21) Appl. No.: 13/337,720

(22) Filed: Dec. 27, 2011

(65) Prior Publication Data

US 2012/0204692 A1 Aug. 16, 2012

(30) Foreign Application Priority Data

Feb. 10, 2011 (EP) ..... 11001073

(51) Int. Cl.

| | |
|---|---|
| ***B26D 1/62*** | (2006.01) |
| ***B26D 7/18*** | (2006.01) |
| ***B26F 1/38*** | (2006.01) |
| ***B26D 7/26*** | (2006.01) |
| ***B21D 28/12*** | (2006.01) |
| ***B26F 1/42*** | (2006.01) |
| ***B21D 28/36*** | (2006.01) |
| *B26F 1/20* | (2006.01) |

(52) U.S. Cl.

CPC ..... *B26F 1/384* (2013.01); *B26D 7/2628* (2013.01); *B26D 7/2614* (2013.01); *B21D 28/12* (2013.01); *B26D 7/1854* (2013.01); *B26F 1/20* (2013.01); *B26F 1/42* (2013.01); *B21D 28/36* (2013.01)

USPC ..... 83/100; 83/98; 83/346

(58) Field of Classification Search

CPC ..... B21D 28/12; B21D 28/36; B26D 7/1854; B26D 7/2614; B26D 7/2628; B26D 1/185; B26D 1/225; B26D 5/20; B26D 7/18; B26D 7/2635; B26D 5/00; B26D 5/08; B26D 5/02; B26F 1/20; B26F 1/384; B26F 1/405; B26F 1/02; B41J 11/663; B41J 11/68; B31B 2201/146

USPC ..... 83/100, 346, 98, 669, 628, 627, 698.51, 83/345, 670, 677, 678, 30, 8, 309, 527, 83/673–675, 663, 687

See application file for complete search history.

(56) References Cited

U.S. PATENT DOCUMENTS 3,194,095 A * 7/1965 Buck et al. ..... 83/100
3,508,460 A * 4/1970 Goettsch ..... 83/56

(Continued)

FOREIGN PATENT DOCUMENTS

DE 26 07 812 A1 9/1976
DE 298 05 004 U1 7/1998

(Continued)

*Primary Examiner* — Ghassem Alie
(74) *Attorney, Agent, or Firm* — Oliff PLC

(57) ABSTRACT

In order to punch a moving material web there are two punching units present, which are arranged one after another in the direction of movement of the material web. Each punching unit has two punching tools, which interact with a rotatably mounted back-pressure cylinder that can be driven. The punching tools are arranged on a rotatably mounted drive shaft that can be driven, and their position can be adjusted in the direction of the longitudinal axis of the latter and locked in various working positions. Each punching tool has a cylindrical base, to the periphery of which a punching strip which is provided with at least one punching shape is fixed such that it can be replaced. The drive shafts can be driven independently of the associated back-pressure cylinder.

13 Claims, 9 Drawing Sheets

(56) References Cited

U.S. PATENT DOCUMENTS

| | | | | | |
|---|---|---|---|---|---|
| 3,541,656 | A | * | 11/1970 | Devon | 226/191 |
| 3,602,080 | A | * | 8/1971 | Sickel | 83/100 |
| 3,998,116 | A | | 12/1976 | Helm | |
| 4,434,690 | A | * | 3/1984 | Mauer | 83/13 |
| 5,088,367 | A | | 2/1992 | Cracchiolo et al. | |
| 5,144,874 | A | * | 9/1992 | Garrett | 83/332 |
| 5,775,193 | A | | 7/1998 | Pratt | |
| 2007/0000367 | A1 | | 1/2007 | Pfaff, Jr. | |

FOREIGN PATENT DOCUMENTS

| | | | |
|---|---|---|---|
| DE | 103 14 959 | A1 | 10/2004 |
| DE | 20 2009 012 625 | U1 | 1/2010 |
| DE | 20 2009 012 626 | U1 | 1/2010 |
| DE | 10 2009 033 576 | A1 | 1/2011 |
| WO | WO 2011/006992 | A1 | 1/2011 |

* cited by examiner

APPARATUS FOR PUNCHING MOVING MATERIAL WEBS

The present invention relates to an apparatus for punching or perforating moving material webs.

DE 103 14 959 A1 discloses a punching unit which has a plurality of punching tools which are mounted on a shaft, the mutual spacing of which can be adjusted and which are intended to interact with a back-pressure cylinder. Each punching tool has a cylindrical disk, on the periphery of which a metal strip provided with punching profiles is detachably retained.

DE 298 05 004 U1 discloses another embodiment of a punching tool, which likewise has a cylindrical disk, on the periphery of which a metal punching sheet provided with a punching profile is detachably retained. This punching tool is provided with a device for attracting the punched-out parts (punch blanks) by suction and subsequently discharging them.

The present invention is now based on the object of devising an apparatus for punching moving material webs which permits alteration of the arrangement and/or shape (contour) of the parts to be punched out (punch blanks) in a simple and time-saving manner.

According to the invention, this object is achieved by an apparatus which has some features described herein.

Preferred further refinements of the inventive apparatus form the subject matter of some features described herein.

Figure 1:
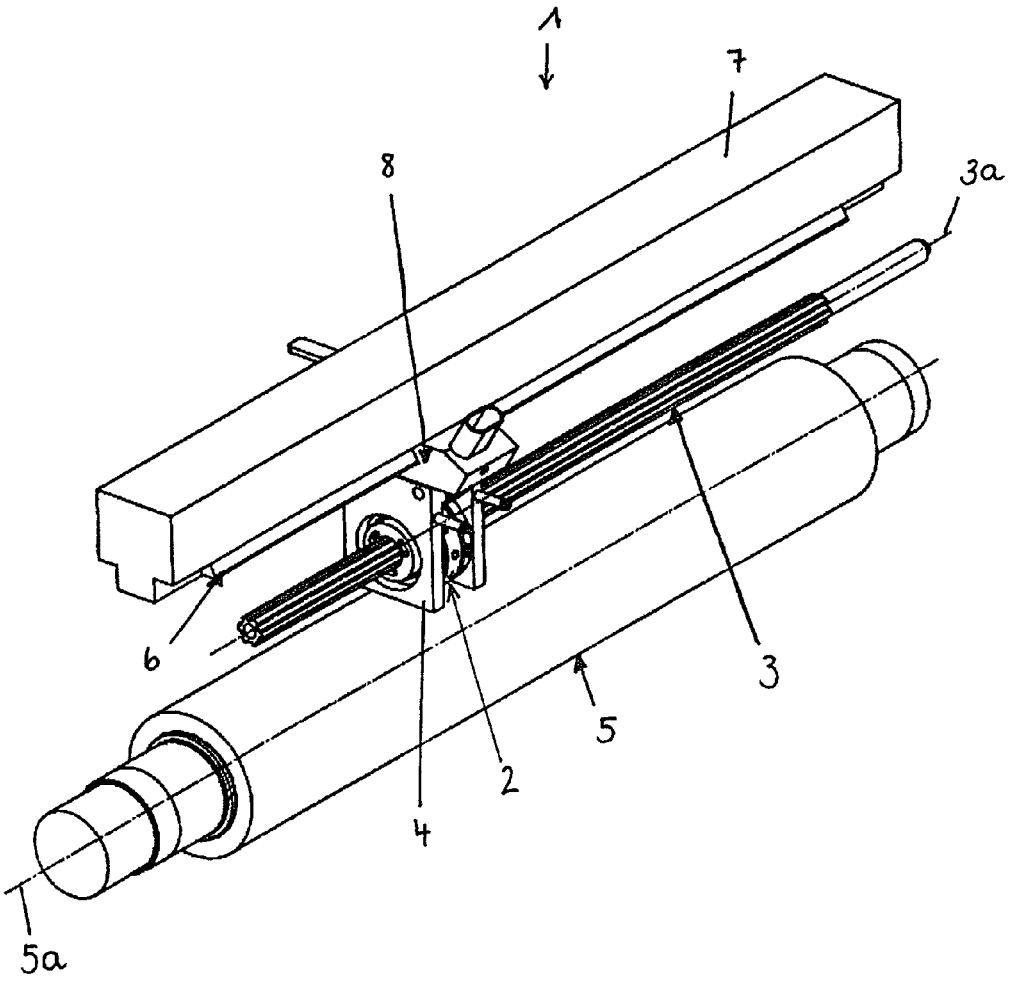
Figure 3:
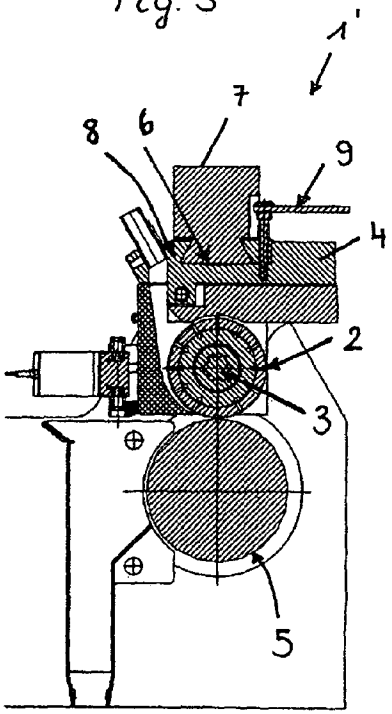
Figure 2:
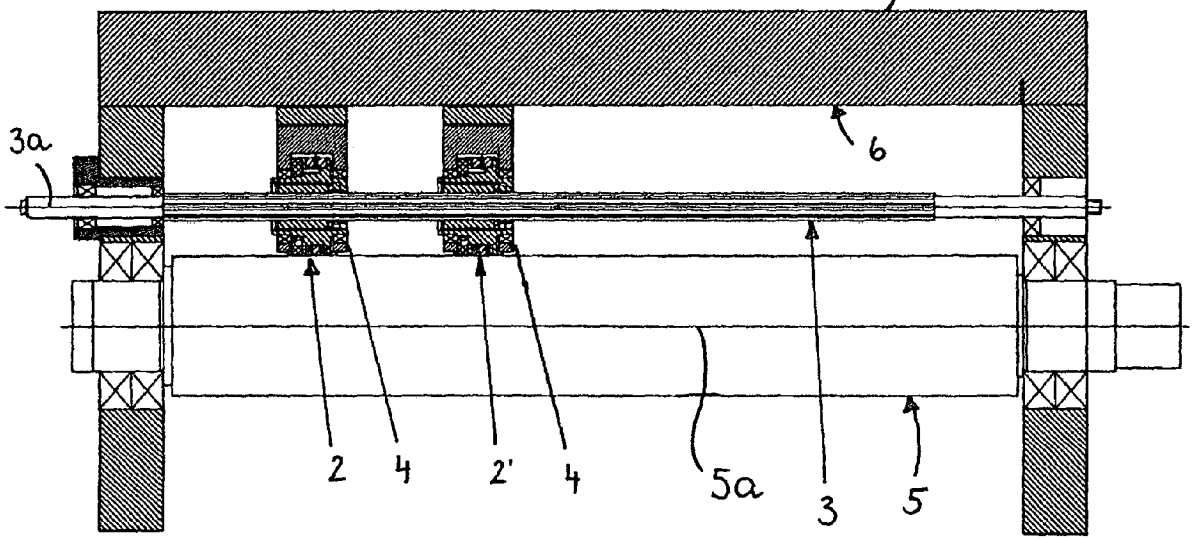
Figure 4:
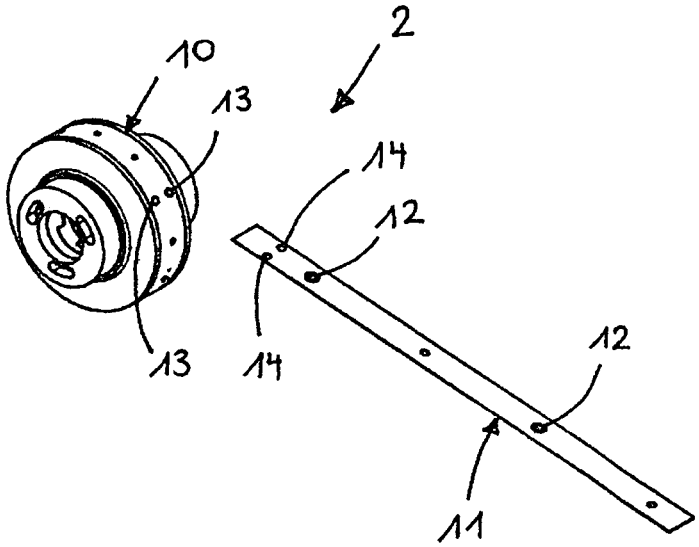
Figure 5:
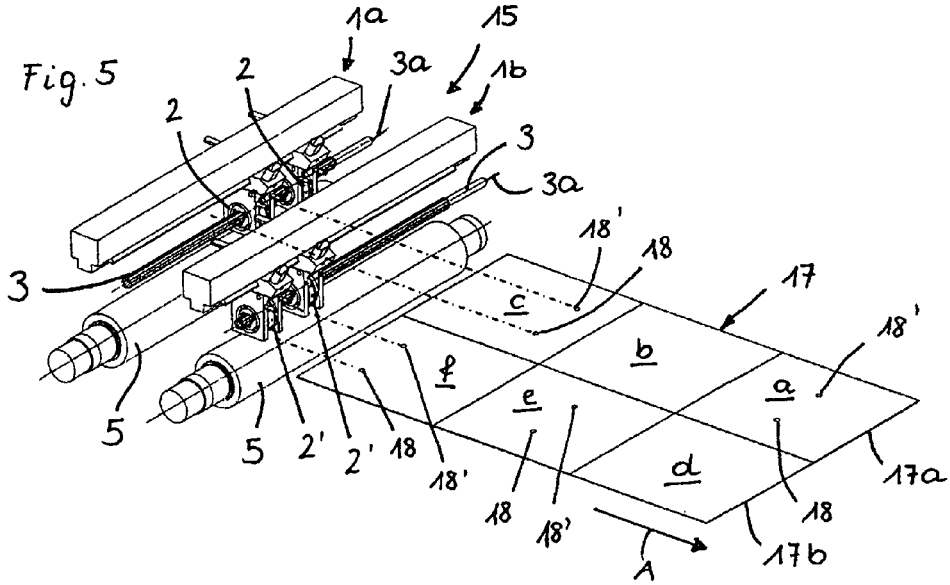
Figure 6:
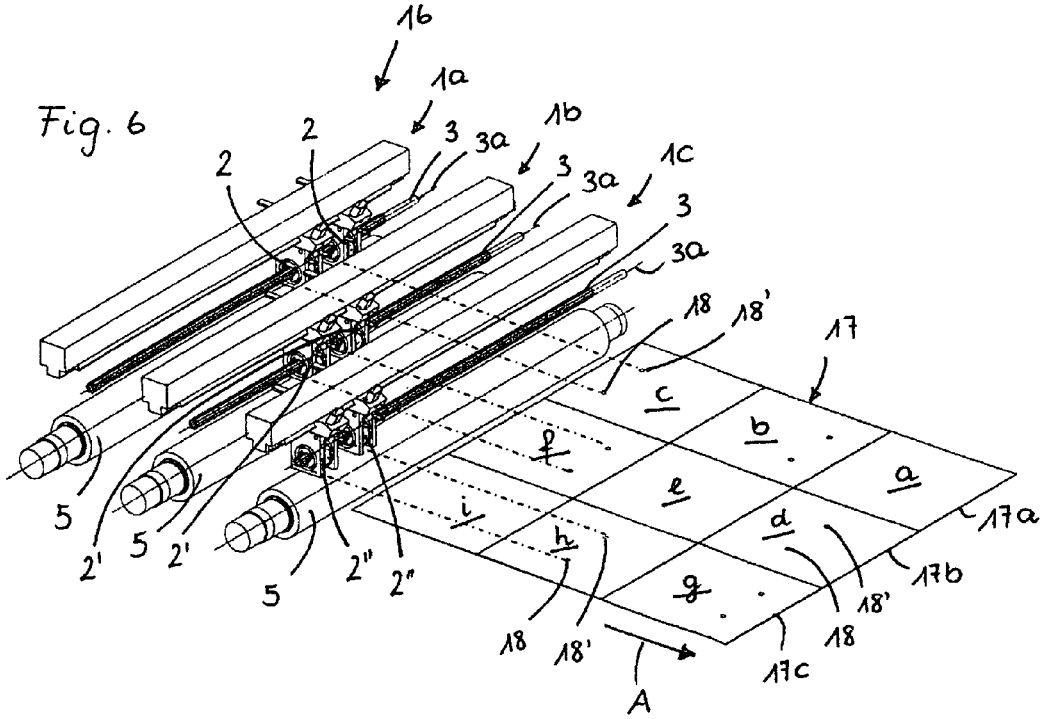
Figure 7:
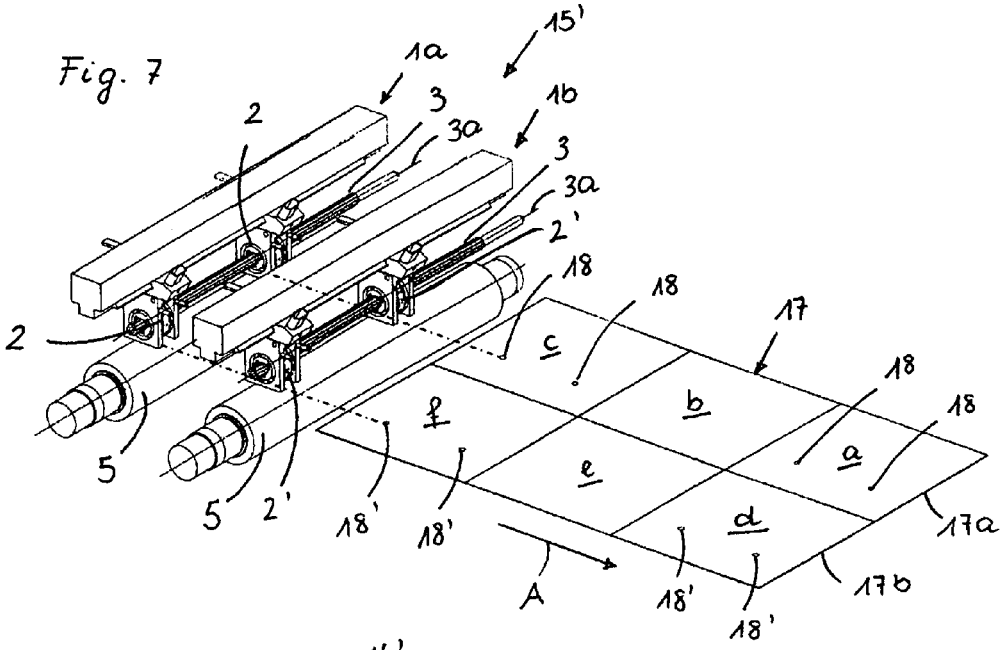
Figure 8:
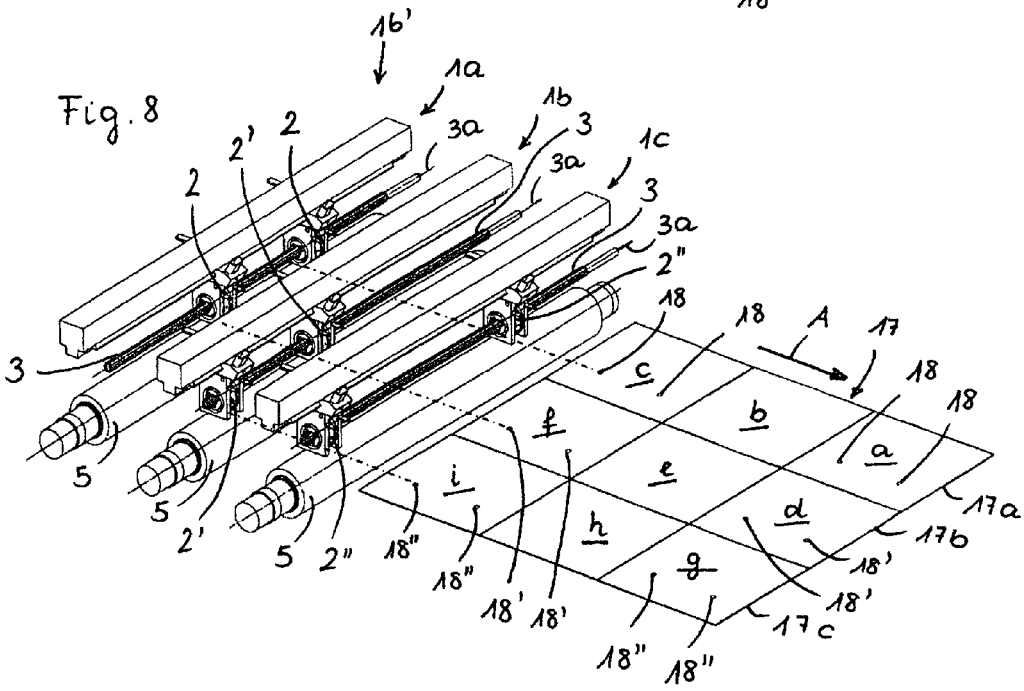
Figure 9:
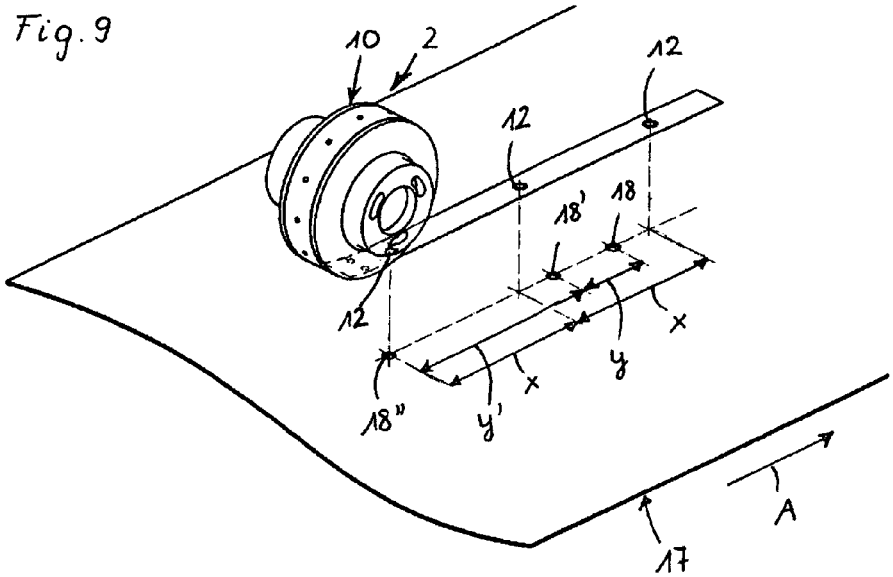
Figure 10:
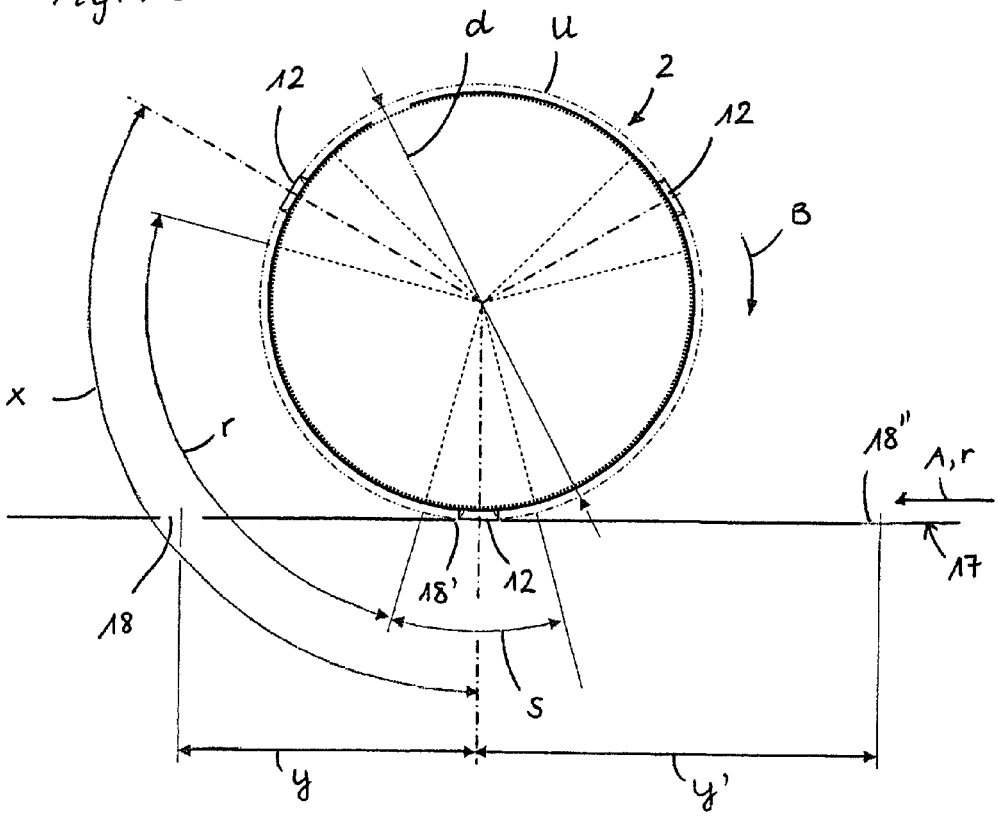
Figure 11:
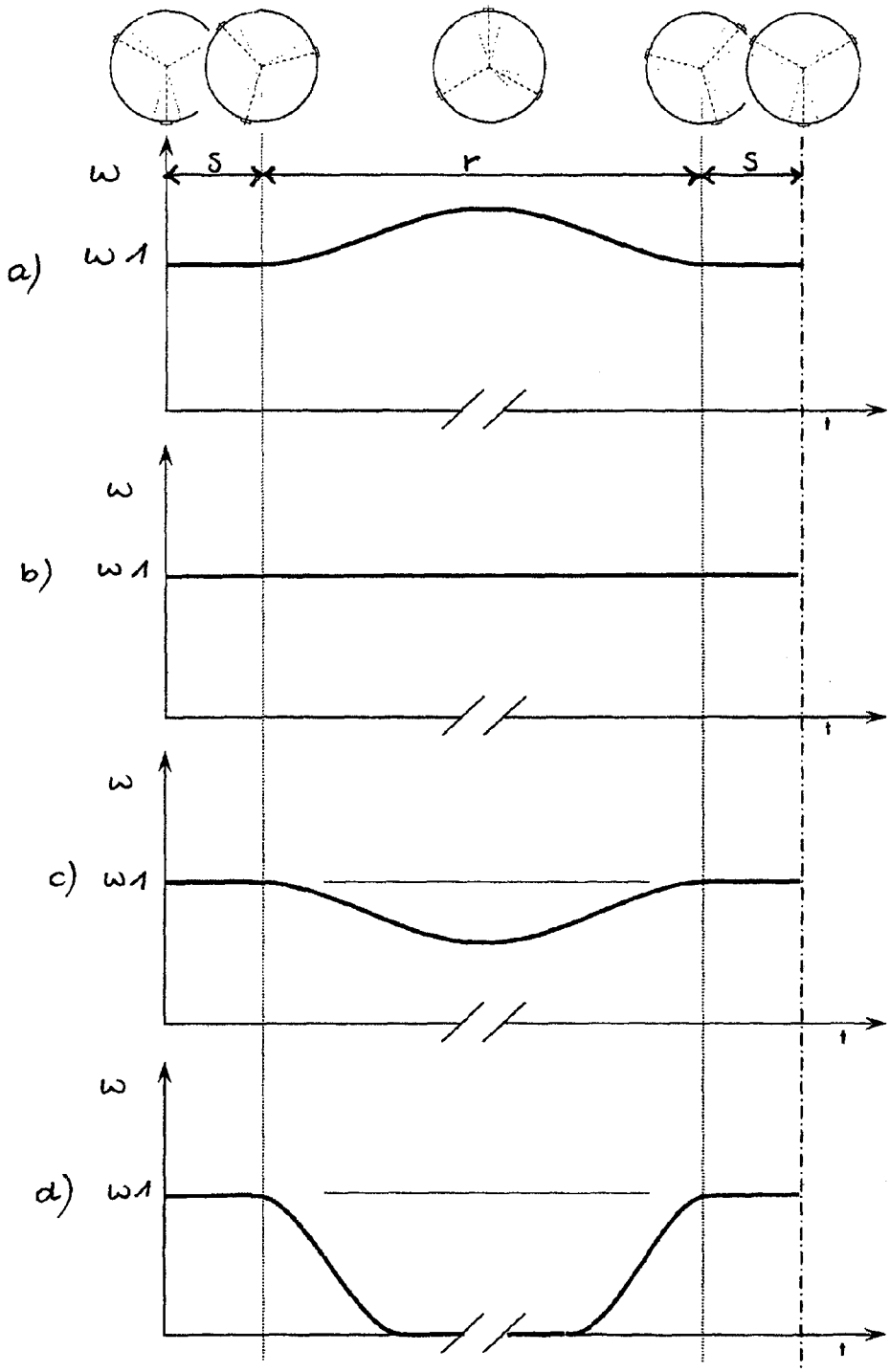
Figure 12:
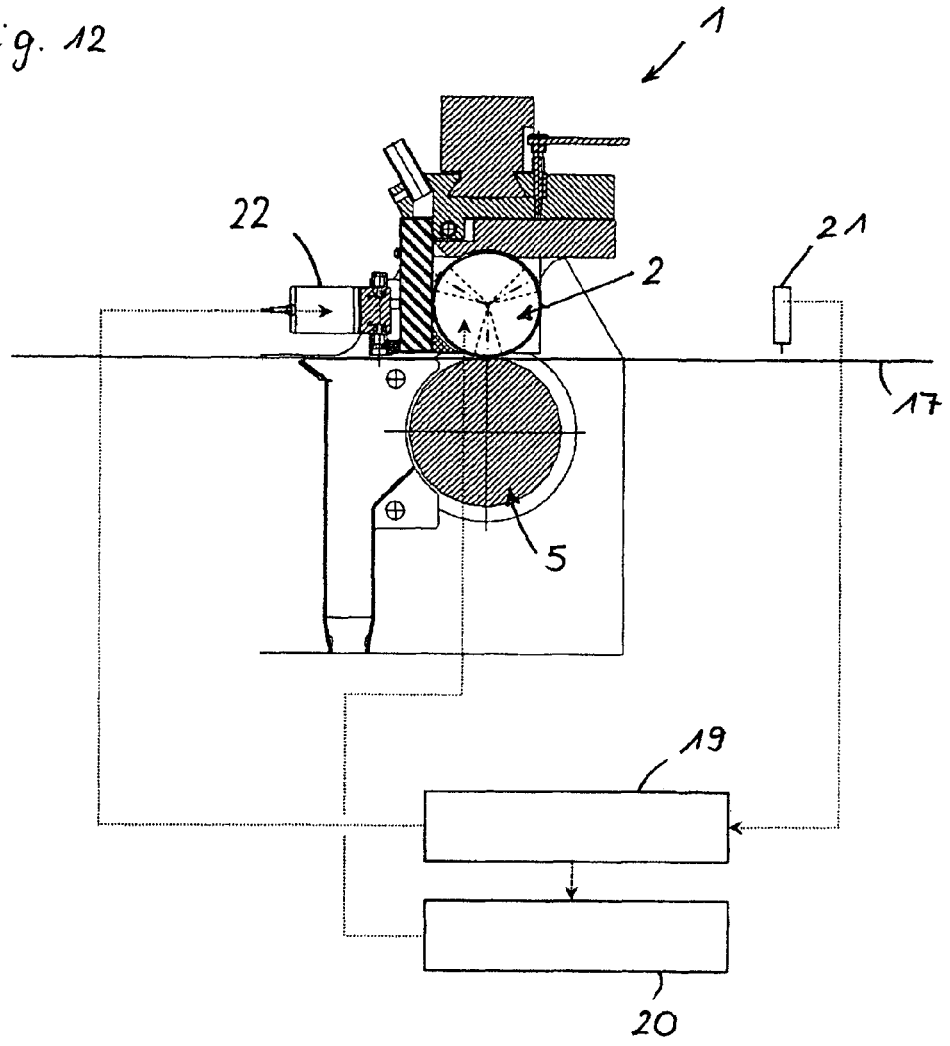
Figure 14:
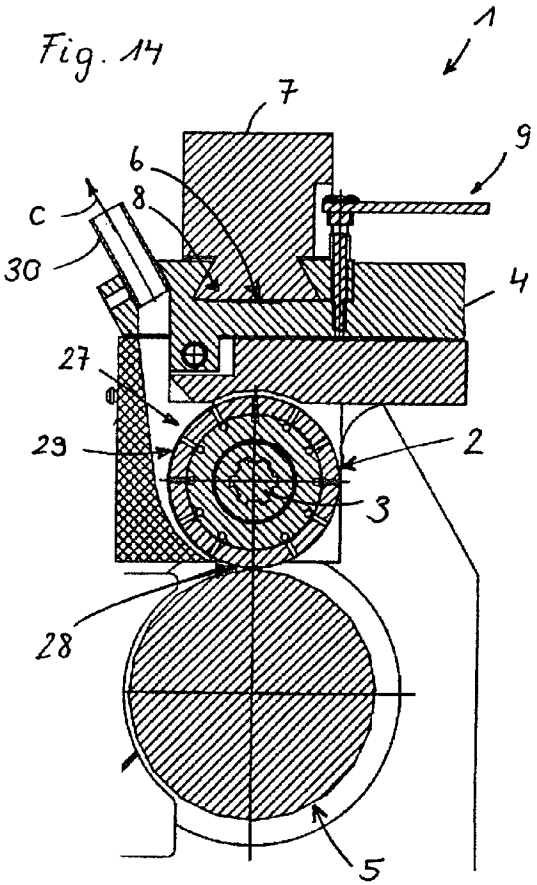
Figure 13:
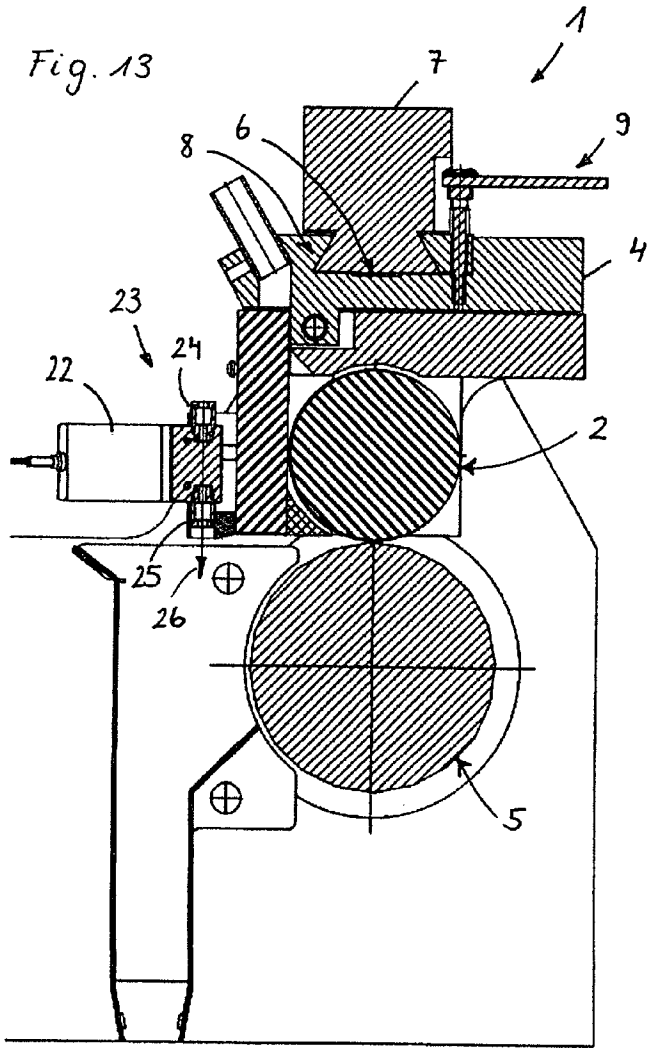

In the following text, the subject matter of the invention will be explained in more detail by using the figures, in which, purely schematically:

FIG. 1 shows a perspective view of a punching unit having a punching tool,

FIG. 2 shows a longitudinal section of a punching unit having two punching tools, FIG. 3 shows the punching unit according to FIG. 2 in a cross section, FIG. 4 shows a perspective view of a punching tool, FIG. 5 shows a perspective view of a first embodiment of a punching apparatus having two punching units, FIG. 6 shows a perspective view of a first embodiment of a punching apparatus having three punching units, FIG. 7 shows a perspective view of a second embodiment of a punching apparatus having two punching units, FIG. 8 shows a perspective view of a second embodiment of a punching apparatus having three punching units, FIG. 9 shows a perspective view in simplified form of the punching of holes in a material web, FIG. 10 shows a side view in simplified form of a punching tool with the material web to be processed, FIG. 11 shows a schematic illustration of the variation in the speed of rotation of the punching tool in different punching situations, FIG. 12 shows a block diagram of the control system for a punching unit, FIG. 13 shows a cross section of a punching unit having a first embodiment of a device for transporting the punched-out parts away, and FIG. 14 shows a cross section of a punching unit having a second embodiment of a device for transporting the punched-out parts away.

If, in the following description of figures and in the claims, mention is made of "punching", then this term is understood to mean both the actual punching (severing) and perforating, in which the perforated part remains temporarily connected to the material web via weakened points (perforations) and is separated out later.

By using FIGS. 1 to 4, the structure of two different embodiments of punching units 1 and 1' will be described. The two embodiments differ only in the fact that the punching unit 1 (FIG. 1) has one punching tool 2, and the punching unit 1' has two punching tools 2, 2', which are of the same design.

The punching tools 2 or, respectively, 2, 2' are rotationally firmly connected to a drive shaft 3 which, in the present exemplary embodiments, is a splined shaft. The drive shaft 3 is mounted such that it can rotate about its axis of rotation 3*a* and is connected to a drive device, not shown. Each punching tool 2 and 2' is rotatably mounted in a tool holder 4 and, together with the latter, can be displaced along the drive shaft 3 in the direction of the axis of rotation 3*a* of the latter into various working positions. The punching tools 2, 2' interact with a back-pressure cylinder 5, which is mounted such that it can rotate about its axis of rotation 5*a* and is connected to a drive device, not shown. Each punching tool 2, 2' is mounted, for example by using a radial coupling, in such a way that the distance between the punching tool 2, 2' and the back-pressure cylinder 5 can be set individually (FIGS. 2 and 3). The back-pressure cylinder 5 has a smooth surface, which is preferably hardened. The axis of rotation 3*a* of the drive shaft 3 and the axis of rotation 5*a* of the back-pressure cylinder 5 run parallel to each other.

The punching tools 2, 2' are guided by means of a guide (sliding guide), which is formed on the underside of a guide beam 7 and which extends over the entire working width of the punching unit 1. This guide 6 runs parallel to the axis of rotation 5*a* of the back-pressure cylinder 5. A correspondingly formed guide 8, which is formed on the tool holder 4, interacts with the guide 6 (see in particular FIG. 3). The tool holder 4 and, with the latter, the punching tools 2, 2' can be displaced in a translational manner along the guide 6 between different working positions. By means of a locking apparatus 9 illustrated only schematically (FIG. 3), the punching tool 2, 2' can be locked in any working position. Thus, it is also possible, in the punching unit 1' shown in FIG. 2, to adjust, i.e. to change, the mutual spacing between the punching tools 2, 2'.

In FIG. 4, the structure of the punching tool 2 or 2' is shown. The punching tool 2 or 2' has a cylindrical base 10, on the periphery of which a punching strip 11 is detachably retained. The punching strip 11 is preferably a metal strip, which is held on the base 10 by means of magnetic force. The punching strip 11 is provided with a number of punching shapes 12, which are arranged distributed over the length of the punching strip 11. Here, the distances between the punching shapes 12 can be the same or different. The punching shapes 12 can have the same shape or different shapes (contours). Provided on the periphery of the base 10 are positioning pins 13 which, when the punching strip 11 is mounted, engage in positioning holes 14 on the punching strip 11. In this way, the punching strip 11 is positioned correctly. It goes without saying that the punching strips 11 can also be fixed replaceably to the base 10 in another suitable way. In this connection, reference is made, for example, to DE 103 14 959 A1 and DE 298 05 004 U1, already mentioned. It is also conceivable to arrange a plurality of punching strips 11 on the periphery of the base 10.

For each punching unit 1, 1', more than two punching tools 2 can also be provided on the drive shaft 3.

By using FIGS. 5 to 8, exemplary embodiments of punching apparatuses 15 and 16 will be described which have two punching units 1*a*, 1*b* and, respectively, three punching units 1*a*, 1*b*, 1*c*, which are arranged one after another as seen in the direction of movement A of a material web 17 to be processed. In terms of structure, the punching units 1*a*, 1*b*, 1*c* correspond to the punching unit 1' shown in FIGS. 2 and 3 and each have two punching tools 4. Therefore, in FIGS. 5 to 8, the same designations will be used as in FIGS. 1 to 4 for mutually corresponding parts.

The exemplary embodiments shown in FIGS. 5 and 6 differ from one another only in a different number of punching units 1*a*, 1*b* and 1*a*, 1*b*, 1*c*. In both the exemplary embodiments, in each case the punching tools of the one punching unit la are displaced with respect to the punching tools 2', 2" of the other punching unit 1*b* and 1*c*, respectively, in the direction of the axis of rotation 3*a* of the drive shafts 3, which therefore means in a direction which runs transversely, in particular at right angles, to the direction of movement A of the material web 17. Likewise, the punching tools 2' of the punching unit 1*b* are offset with respect to the punching tools 2" of the punching unit 1*c*. This means that the punching tools 2 of the punching units 1*a*, 1*b*, 1*c* process different areas of the material web 17.

In the embodiment according to FIG. 5, the punching tools 2 of the punching unit la are used to punch holes 18, 18', which are used for example as storage holes, in the section 17*a* of the material web 17, while, by using the tools 2' of the second punching unit 1*b*, holes 18, 18' are punched in the material web section 17*b*. As FIG. 5 shows, in both the material web sections 17*a*, 17*b*, different punching can be carried out. For instance, in the material web section 17*a*, the areas a and c are provided with holes 18, 18', while the area b has no punching. By contrast, in the material web section 17*b*, the holes 18, 18' are made in the areas e and f, while the area d has no punching.

The same is true in a corresponding way in the embodiment according to FIG. 6, in which three sections 17*a*, 17*b*, 17*c* of the material web 17 can be processed differently. The tools 2 of the punching tool 1*a* process the material web section 17*a*, the punching tools 2' of the punching tool 1*b* process the material web section 17*b*, and the punching tools 2" of the punching tool 1*c* process the material web section 17*c*.

As FIG. 6 shows, regions a, d, g and, respectively, b, e, h and, respectively, c, f, e lying beside one another and belonging to the material web sections 17*a*, 17*b*, 17*c* are processed differently.

The exemplary embodiments according to FIGS. 7 and 8 also differ from one another only in a different number of punching units 1*a*, 1*b* and 1*a*, 1*b*, 1*c*. In both exemplary embodiments, in each case a punching tool 2, 2', 2" of a punching unit 1*a*, 1*b*, 1*c*, as seen in the direction of movement A of the material web 17, is aligned with a punching tool 2, 2' and, respectively, 2" of a different punching unit 1*a*, 1*b* and, respectively, 1*c*.

In the embodiment shown in FIG. 7, in each case one of the punching tools 2 of the punching unit 1*a* is aligned with a punching tool 2' of the other punching unit 1*b*. Each pair of mutually aligned punching tools 2, 2' makes holes 18, 18' in one of the two material web sections 17*a*, 17*b*. Here, in each case one of the two holes 18 and 18' which are made in a material web area a, c, d and f, respectively, is punched by the punching tool 2 of the punching unit 1*a*, and the other of the two holes 18, 18' is punched by the punching tool 2' of the other punching unit 1*b*.

In the embodiment according to FIG. 8, the mutually aligned punching tools 2, 2" of the punching units 1*a*, 1*c* are used to punch holes 18 in material web section 17*a*, while the mutually aligned punching tools 2, 2' of the punching units 1*a*, 1*b* are used to punch holes 18' in material web section 17*b*. By means of the mutually aligned punching tools 2', 2" of the punching units 1*b*, 1*c*, the holes 18" are punched out in the material web section 17*c*. In this way, the individual areas a, d, g and, respectively, b, e, h and, respectively, c, f, i of the material web sections 17*a*, 17*b*, 17*c* can be processed differently from one another.

It goes without saying that, in the exemplary embodiment shown in FIG. 8, the punching tools 2, 2', 2" can also be aligned with one another in a different arrangement than as shown.

If, in the embodiments shown in FIGS. 5 to 8, punching strips 11 with differently formed punching shapes 12 are used in the punching tools 2, 2', 2", then punchings with different contours can be produced in the material web sections 17*a*, 17*b*, 17*c*.

Furthermore, it is possible, in the same punching apparatus, to combine the mutual arrangement of the punching tools 2, 2', 2" which has been explained by using FIGS. 5 and 6 and the mutual arrangement of the punching tools 2, 2', 2" which has been explained by using FIGS. 7 and 8. In such a solution, some of the punching tools 2, 2', 2" are aligned with one another as described, and some of the punching tools 2, 2', 2" are offset laterally relative to one another.

The arrangements of the punchings (holes) 18, 18', 18" illustrated by using FIGS. 5 to 8, i.e. the punching patterns in the areas a-i of the material web 17, can be changed without any great expenditure of time. For example, the spacings between the punchings 18, 18', 18", as seen in the direction of movement A of the material web, and/or the number of punchings 18, 18', 18" per material web area a-i can be changed.

In all the exemplary embodiments described, the material web 17 is moved forward with a constant or changing speed v in a manner that is not illustrated in more detail but known per se. The back-pressure cylinder 5 of each punching unit 1 is driven at a peripheral speed which corresponds to the speed of movement v of the material web 17. In each punching unit 1, the drive shaft 3 is driven independently of the back-pressure cylinder 5. This means that the drive shaft 3 can be driven at a rotational speed which differs from the peripheral speed of the back-pressure cylinder 5 and therefore from the speed of movement v of the material web 17. This enables adaptation of the punchings to be made in the material web 17 during operation, as will be explained in more detail below by using FIGS. 9 to 11.

The material web 17 provided with punchings 18 is then processed further and cut or folded in the longitudinal and/or transverse direction in a manner known per se.

With reference to FIGS. 9 to 11, an important aspect of the subject matter of the invention will now be described, namely the possibility of punching holes 18 in the material web 17, the mutual spacing of which does not correspond to the spacing of the punching shapes 12 of the punching strip 11.

In FIG. 9, a punching tool 2 having a punching strip 11 wound on is shown in an illustration corresponding to the illustration of FIG. 4. The spacing, uniform in this case, between the punching shapes 12 of the punching strip 11 is designated by x. FIG. 9 also shows a material web 17 in which holes 18, 18', 18" are to be punched out, the mutual spacings y and y' of which differ from the spacings x between the punching shapes 12.

In the side view of FIG. 10, in which the punching tool 2 is illustrated only wholly schematically, as is the material web 17 having the holes 18, 18', 18" made or to be made, the spacings x and y between the punching shapes 12 and between the holes 18, 18', 18" are shown. In this FIG. 10, the direction of rotation (reference direction of rotation) of the punching tool 2 is designated by B, and its working diameter, which is determined by the cutters of the punching shapes 12, is designated by d. A working circumference U of the punching tool 2 is defined by these cutters of the punching tools 2 and, respectively, by the working diameter d. In FIG. 10, s designates an angle which defines a synchronizing region. Each punching tool 12 is assigned such a synchronizing region s. The angle designated by r is designated a dynamic region. Such a dynamic region is located between each punching shape 12.

In order to punch the holes 18, 18', 18" with unequal mutual spacings y, y', the punching tool 2 is in each case driven in the synchronizing region s with a peripheral speed at the working circumference U which is equal to the speed of movement v of the material web 17. In this synchronizing region s, the punching of the holes 18, 18' and 18" is then carried out. In the dynamic regions r, the peripheral speed of the punching tool 2 can be varied and the spacing y, y' between the holes 18 and 18' just punched and the next hole 18' or 18" to be punched can be adapted appropriately. This is now to be explained by using FIG. 11.

In FIGS. 11*a* to 11*d*, graphs relating to various punching operations are shown, in which in each case the angular velocity ω of the punching tool 2 is shown as a function of the time t. In these graphs, the variations in speed are shown in two synchronizing regions s, in which in each case punching is carried out, and in a dynamic region r lying in between. Above the graphs, the punching tool 2 is illustrated schematically in its various respective rotational positions. ω1 designates that angular velocity of the punching tool 2 which corresponds to a peripheral speed of the punching tool 2 which coincides with the speed of movement v of the material web 17. This means that, in the synchronizing regions s, the punching tools 12 run synchronously with the material web 17. Appearances are different in the dynamic region r, in which the angular velocity ω of the punching tool 2 can be chosen independently of the speed of movement v of the material web 17, specifically in a manner matched to the ratio of the spacings y, y' between the holes 18, 18', 18" to the spacing x between the punching shapes 12.

In the graph of FIG. 11*a*, the variation over time of the angular velocity ω of the punching tool 2 is shown in the situation in which the spacing y, y' between two holes 18, 18', 18" is smaller than the spacing x between the punching shapes 12. In this case, the angular velocity ω in the dynamic region r must be increased briefly, which means the punching tool 2 must be accelerated and then retarded again to the angular velocity ω1.

If the spacing y, y' between two holes 18, 18', 18" is the same as the spacing x between the punching shapes 12, then the punching tool 2 in the dynamic region r continues to be driven with the angular velocity ω1, as illustrated in graph 11*b*. In this case, the punching tool 2 neither has to be accelerated briefly nor retarded briefly.

In the graph of FIG. 11*c*, the variation over time of the angular velocity ω of the punching tool 2 is shown for the situation in which the spacing y, y' between two holes 18, 18', 18" is greater than the spacing x between the punching shapes 12. In this case, the angular velocity ω in the dynamic region r must be reduced briefly, which means that the punching tool 2 must be retarded and then accelerated to the angular velocity ω1 again.

If no hole (punching) has to be made in an area of the material web 17 (see, for example, the material web areas b and d in FIG. 5), then after a punching, the punching tool 2 is stopped briefly within the following dynamic region r and, before reaching the following synchronizing region s, is accelerated to the angular velocity ω1 again, as illustrated in the graph according to FIG. 11*d*.

In certain cases, the direction of rotation of the punching tool 2 is reversed in the dynamic region r, i.e. the punching tool 2 is rotated briefly in the reverse direction.

As described, by means of controlled acceleration and retardation of the punching tool 2 in the dynamic region r, the spacing y between two punchings 18, 18', 18" can be influenced. In this way, it is possible to obtain spacings y between the punchings 18, 18', 18" which do not correspond to the spacings x between the punching shapes 12 of the punching strip 11. Merely by changing the peripheral speed of the punching tool 2 in the dynamic region r, it is possible to produce different punching patterns without mechanical transpositions being necessary.

In order that the angular velocity ω of the punching tool 2 can be changed as required, as by using FIG. 11, in such a way that the punchings 18 in the material web 17 are made at the desired locations, the drive for the punching tool 2 must be controlled appropriately. In FIG. 12, a block diagram of a corresponding control device is illustrated. In this FIG. 12, in an illustration corresponding to that of FIG. 3, a punching unit 1 is shown, of which only the components important in connection with the control system are provided with the corresponding designations.

In this FIG. 12, the machine control system is designated by 19 and the drive control system for the drive of the drive shaft 3 of the punching tool 2 is designated by 20. The machine control system 19 is connected to a sensor 21, a contrast sensor in the present case, which scans markings applied to the material web 17 and feeds corresponding scanning signals to the machine control system 19. The machine control system 19 is further connected to a control valve 22 of an output transport device for leading the punched-out parts (punch blanks) away, which will be explained in more detail by using FIG. 13, and is also connected to the drive control system 20.

In the machine control system 19, the information relating to the position of the punchings 18 to be made in the material web 17 and the speed of movement v of the material web 17 is stored. From these variables, the angular velocity ω1 is derived.

On the basis of the scanning signals obtained from the sensor 21 and the data stored in the machine control system 19 or determined in the latter, the machine control system 19 then determines the angular velocity ω at which the punching tool 2 must be driven in the dynamic region r in order that the punching/s is/are carried out in the correct position. In addition, the machine control system 19 activates the control valve 22 of the output transport device at the correct time.

In FIGS. 13 and 14, sectional illustrations corresponding to FIG. 3 of two different embodiments of output transport devices for the punched-out parts, which means the punch blanks, are shown.

In the embodiment according to FIG. 13, the punch blanks are separated out of the material web 17 and transported away by means of a time-coordinated compressed air surge. The punch blanks separated out can be attracted by suction or fed to a collecting container arranged underneath the material web. The output transport device 23 used to separate out the punch blanks is illustrated only wholly schematically and has the control valve 22 already mentioned in connection with FIG. 12. The inlet of the control valve 22 is connected to a compressed air connection 26, which is connected to a compressed air source, not illustrated. On the outlet side, the control valve 22 is connected to a blower nozzle 25.

When the control valve 22 is activated by the machine control system 19 (FIG. 12), the connection between the compressed air connection 24 and the blower nozzle 25 is opened briefly. A compressed air surge 26 is produced, which blows the punch blank out of the material web 17. It is important that the activation of the control valve 22 is carried out at the correct time, in order that the compressed air surge 26 is generated when the punch blank is located underneath the blower nozzle 25.

In the output transport device 27 shown in FIG. 14, which is also illustrated only wholly schematically, the punch blanks are attracted to the punching tool 2 by suction by means of negative pressure in a suction region 28, which corresponds to the synchronizing region s shown in FIG. 10. During the onward rotation of the punching tool 2, the punch blank is separated from the punching tool 2 again in a blow-off region 29, which lies in a dynamic region r (FIG. 10), specifically either blown away by means of a positive pressure and/or sucked away by means of negative pressure. The punch blanks separated from the punching tool 2 are carried away by a suction line 30.

It goes without saying that the output transport devices 23 and 27 described can be provided both in a punching unit 1 according to FIG. 1 and in a punching unit 1' according to FIG. 2. It is also possible, in order to transport the punch blanks away, to provide both an output transport device 23 according to FIG. 13 and an output transport device 27 according to FIG. 14. This means that, in one and the same punching tool 2, the punch blanks are transported away in two different ways.

A further important aspect of the present invention is the following:

A punching unit 1, as shown in FIG. 1, FIG. 2 or in FIGS. 5 to 8, has at least one punching tool 2 which interacts with a rotatably mounted back-pressure cylinder 5 that can be driven and which is arranged on a rotatably mounted drive shaft 3 that can be driven. This punching unit 1 also has a guide 6 extending in the direction of the axis of rotation 3*a* of the drive shaft 3 and separate from this drive shaft 3, along which guide the punching tool 2 is guided during adjustment and which extends parallel to the longitudinal axis 5*a* of the back-pressure cylinder 5.

This specific refinement of the punching unit 1, as defined in claim 15, has the advantage that the drive shaft 3 does not have to fulfill any guide tasks and only has to be designed to transmit the drive power. This makes it possible to use lighter drive shafts 3 and in this way to keep the masses which have to be accelerated and retarded during a change in the drive speed of the punching tools 2 in the dynamic region r (FIG. 10) as small as possible.

As described, a punching unit 1, 1' or a plurality of punching units 1*a*, 1*b*, 1*c* arranged one after another are used, of which each punching unit has one or more punching tools 2, which can be adjusted along their drive shaft 3 and can be locked in their respective working positions. This arrangement makes it possible, in a simple way and with relatively little expenditure of time, to transpose the punching units 1 in such a way that the arrangements of the parts to be punched out, which means the punching patterns, are different. By replacing the punching strips 11, which is very easily possible, both the punching patterns but also the shape (contour) of the parts to be punched out can be changed.

Driving the punching tools 2 independently of the back-pressure cylinder 5 widens the area of use of the punching unit 1, as has been explained by using FIGS. 9 to 11.

In a further embodiment, the punching tool 2 or the punching tools 2, 2' are mounted in such a way that these can be moved briefly in the direction away from the back-pressure cylinder 5. This makes it possible also to drive the punching tools 2, 2' in the synchronizing region s at a peripheral speed which differs from the peripheral speed of the back-pressure cylinder 5 and from the speed of movement v of the material web 17. Briefly lifting a punching tool 2, 2' off the back-pressure cylinder 5 and the material web makes it possible to deactivate certain punching shapes 12 during the rotation of the punching tool 2, 2', which means not bringing them into contact with the material web 17, and in this way skipping a punching 18. This means that the sequence of the punchings 18, 18', 18" made in the material web 17 in the direction of movement A of the material web 17 differs from the sequence of punching shapes 12 of the punching tool 2, 2' in the peripheral direction of the latter.

The invention claimed is:

1. An apparatus for punching a moving material web, comprising:

at least two punching units, which are arranged one after another in a direction of movement of the material web, each punching unit has at least one punching tool, which interacts with a rotatably mounted back-pressure cylinder that can be driven, wherein the at least one punching tool is arranged on a rotatably mounted drive shaft that can be driven and wherein a position of the at least one punching tool can be adjusted in the direction of a longitudinal axis of the drive shaft and wherein the at least one punching tool can be locked in various working positions, each punching tool has a cylindrical base, on a periphery of which a flexible punching strip is provided with at least one punching shape is fixed such that the punching strip is wrapped around the periphery of the cylindrical base and can be can be replaced, wherein edges of the punching strips are substantially linear.

2. The apparatus as claimed in claim 1, wherein each punching unit has two or more punching tools, of which the mutual spacing can be adjusted, arranged on the drive shaft.

3. The apparatus as claimed in claim 1, wherein, in the case of one punching tool per punching unit, the punching tool of the one punching unit is offset with respect to the punching tool of the other punching unit, as seen in a direction running transversely with respect to the direction of movement of the material web or wherein, in the case of two or more punching tools per punching unit, at least one of the punching tools of the one punching unit is offset with respect to one of the punching tools of the other punching unit, as seen in a direction running transversely with respect to the direction of movement of the material web.

4. The apparatus as claimed in claim 1, wherein, in the case of one punching tool per punching unit, the punching tool of the one punching unit is aligned with the punching tool of the other punching unit, as seen in the direction of movement of the material web, or wherein, in the case of two or more punching tools per punching unit, at least one of the punching tools of the one punching unit is aligned with one of the punching tools of the other punching unit, as seen in the direction of movement of the material web.

5. The apparatus as claimed in claim 1, wherein the punching tool or at least some of the punching tools of the one punching unit are used to process a first section of the material web extending in the direction of movement of the material web, and the punching tool or at least some of the punching tools of the other punching unit are used to process a second section of the material web likewise extending in the direction of movement of the material web.

6. The apparatus as claimed in claim 1, wherein the punching tool or at least some of the punching tools of the one punching unit and the punching tool or at least some of the punching tools of the other punching unit are used to process the same section of the material web extending in the direction of movement of the material web.

7. The apparatus as claimed in claim 1, wherein each punching unit has a guide extending in the direction of the axis of rotation of the drive shaft, separate from the latter, along which guide the punching tools are guided during adjustment and which extends parallel to the longitudinal axis of the back-pressure cylinder.

8. The apparatus as claimed in claim 1, wherein the punching units extend over the entire width of the material web.

9. The apparatus as claimed in claim 1, wherein the back-pressure cylinders have a smooth surface, which is preferably hardened.

10. The apparatus as claimed in claim 1, wherein the back-pressure cylinders can be driven with a peripheral speed which corresponds to the speed of movement of the material web.

11. The apparatus as claimed in claim 1, wherein each punching tool is mounted in such a way, for example by using a radial coupling, that the distance between the punching tool and the back-pressure cylinder can be set.

12. The apparatus as claimed in claim 1, wherein each punching tool is provided with a device operating with negative pressure for temporarily holding and subsequently discharging the parts punched out from the material web.

13. The apparatus as claimed in claim 1, wherein each punching tool is assigned an output transport device for transporting away the parts punched out of the material web, by means of which the parts punched out are separated out from the material web by means of a jet of a gaseous medium, preferably air, and are transported away.

* * * * *